US006940459B2

(12) United States Patent
Sullivan et al.

(10) Patent No.: US 6,940,459 B2
(45) Date of Patent: Sep. 6, 2005

(54) ANTENNA ASSEMBLY WITH ELECTRICAL CONNECTORS

(75) Inventors: Jonathan L. Sullivan, Lincoln, NE (US); Anthony P. Vejraska, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 96 days.

(21) Appl. No.: 10/334,580

(22) Filed: Dec. 31, 2002

(65) Prior Publication Data

US 2004/0125028 A1 Jul. 1, 2004

(51) Int. Cl.[7] ..... H01Q 1/38
(52) U.S. Cl. ..... 343/702; 343/906

(58) Field of Search ..... 343/702, 906, 343/700 MS; 439/188, 916

(56) References Cited

U.S. PATENT DOCUMENTS

| | | | | |
|---|---|---|---|---|
| 5,539,417 A | * | 7/1996 | Terry et al. | 343/702 |
| 6,271,794 B1 | * | 8/2001 | Geeraert | 343/700 MS |
| 6,473,045 B1 | * | 10/2002 | Duquerroy et al. | 343/702 |
| 6,512,491 B2 | * | 1/2003 | Kanayama et al. | 343/883 |
| 6,664,930 B2 | * | 12/2003 | Wen et al. | 343/702 |
| 6,683,577 B1 | * | 1/2004 | Yang et al. | 343/702 |

* cited by examiner

*Primary Examiner*—Tho Phan
(74) *Attorney, Agent, or Firm*—Holland & Hart

(57) ABSTRACT

The present invention provides an antenna with an integral electrical connection to a printed circuit board.

14 Claims, 5 Drawing Sheets

ANTENNA ASSEMBLY WITH ELECTRICAL CONNECTORS

FIELD OF THE INVENTION

The present invention relates to wireless communication systems and, more particularly, to electrical connections for internal antenna assemblies.

BACKGROUND OF THE INVENTION

Wireless devices use various styles of antennas. The styles can be classified in two generic categories: external and internal. External antennas are generally more efficient than internal antennas. But internal antennas are less prone to damage and usually more aesthetically pleasing.

Internal antennas can be made using a number of different methodologies. One method of making internal antenna is a stamped metal or embossing technique. The stamped metal technique uses thin metal that is stamped and formed into the size and shape needed to form the needed radiator design. This piece of metal is then connected to a non-conductive carriage to form the antenna assembly. Another technique used to manufacture antennas is the flexible film approach. This technique uses a thin layer of conductive material such as copper attached to a thin non-conductive substrate such as Capton or Mylar. The substrate has a thin layer of adhesive on the back surface. To form the radiator geometry, the copper that is not needed is removed by using conventional printed circuit board manufacturing methods. This flexible film is then attached to a rigid structure such as the antenna carriage or the handset housing wall. Yet another method of manufacturing antennas is the multi-shot injection molded, selectively plated technique. The multi-shot technique usually has an injection molded base of non platable plastic with a platable plastic injection molded onto selective portions of the base. The platable plastic is then metalized using one of many various techniques, one of which is electroplating.

Based on the foregoing, it would be desirous to have an improved internal antenna assembly.

SUMMARY OF THE INVENTION

To attain the advantages of and in accordance with the purpose of the present invention, internal antenna assemblies for wireless devices are provided. The internal antenna assemblies include molded connectors integral to the antenna. The molded connector antenna has a core, a plated surface on the core. The molded connector provides electrical connections to a printed circuit board.

BRIEF DESCRIPTION OF THE DRAWING

The above and other objects and advantages of the present invention will be apparent upon consideration of the following detailed description, taken in conjunction with the accompanying drawings, in which like reference characters refer to like parts throughout, and in which.

DETAILED DESCRIPTION

The present invention will be described with reference to FIGS. 1–5. While the present invention is shown with respect to a cellular telephone, other wireless devices could be used, such as, for example, computers, televisions, digital video disc players, compact disc players, personal digital assistants, electronic games, radios, and the like.

PIFA antennas must be electrically connected to the feed and ground ports on printed circuit boards. This can be accomplished in many ways. For metal stamped antennas, the connectors are usually made as part of the actual radiating element. They are thin, stamped metal cantilever beams that are preloaded against a metalized surface on the printed circuit board. Preloading the connectors provides the required contact force through the dimensional "tolerance stack up" range. Often, but not always, the connector is made of the same material as the antenna.

For injection molded antennas, often a stamped metal contact is pressed fit into a molded slot in the plastic structure. The inside of this slot is metalized in such a way as to create an electrical path from the contact to the surface of the antenna. The press fit contact typically has a cantilever beam that contacts the respective ground or feed ports on the printed circuit board.

Instead of the press fit contact and cantilever beam arrangement, the stamped contact could be supported by non plated plastic and a cantilever extending in two directions. One cantilever would contact a plated area on the antenna and the second cantilever would contact the appropriate plated area on the printed circuit board.

In each instance, a separate connector is added to the assembly to connect the antenna and the printed circuit board. The added connector being separate from both the antenna and the printed circuit board increase part count for the assembly and decrease reliability.

Figure 1:
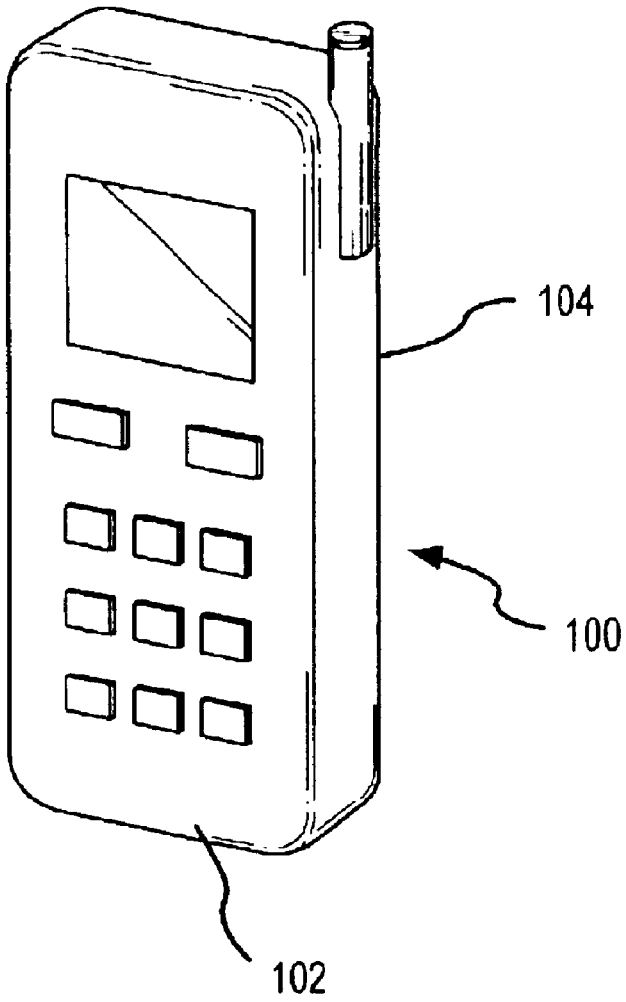
FIG. 1 is a front perspective view of a cellular telephone having an antenna consistent with the present invention.
Figure 2:
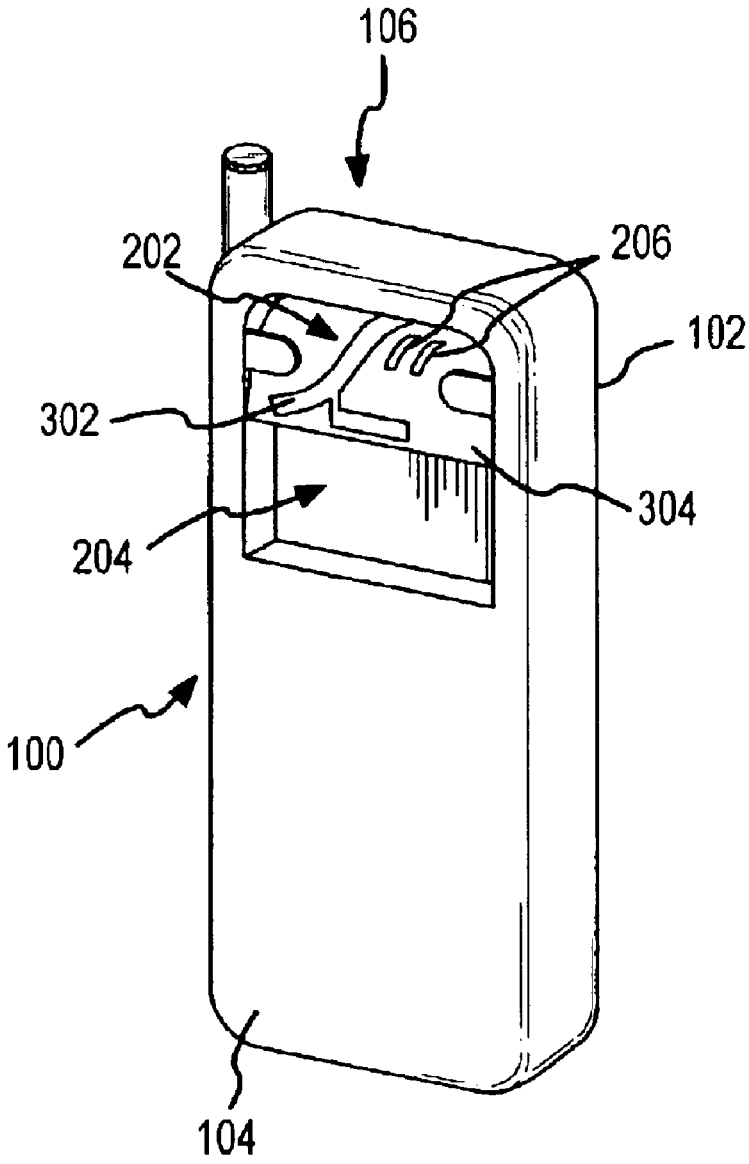
FIG. 2 is a back perspective view the cellular telephone having a cutaway section showing a perspective view of an antenna consistent with the present invention.

FIGS. 1 and 2 show a front and back perspective view of a cellular telephone 100 having a front side 102 and a backside 104. Backside 104 has a cutaway portion 106 showing internal antenna 202 and printed circuit board 204. Internal antenna 202 has ports 206, which will be explained further below. In this case, antenna 202 is a multi-shot injection molded planer inverted F antenna (PIFA), although other antennas are possible.

Figure 3:
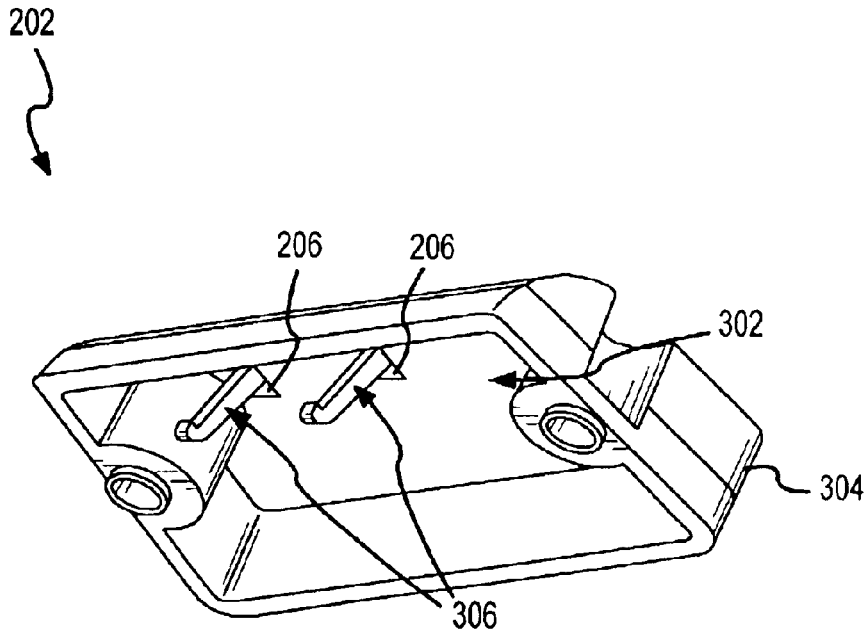
FIG. 3 is a perspective view of a multi-shot, selectively plated injection molded antenna consistent with the present invention.
Figure 4:
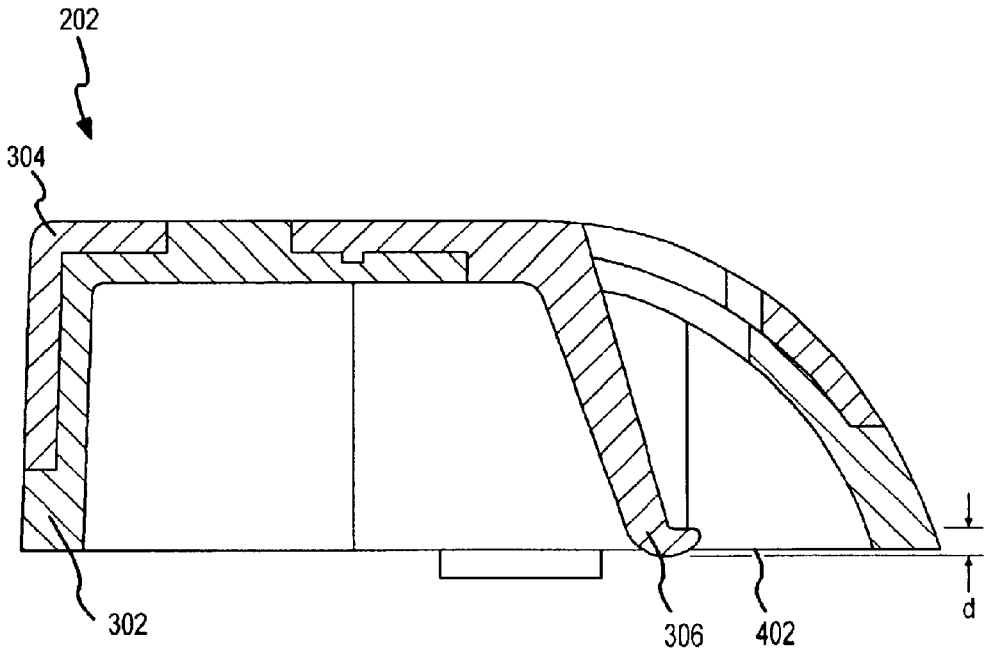
FIG. 4 is a cross sectional view illustrating the electrical connection of the multi-shot, selectively plated injection molded antenna assembly consistent with the present invention.

FIG. 3 shows antenna 202, which in this case is a multi-shot injection molded PIFA. Antenna 202 has a base 302. Base 302 is molded from plastic that does not readily accept metal during the metalization process. Antenna 202 also contains a layer of plateable plastic (not specifically shown or labeled in the drawings) that more readily accepts metal during the metalization process. As shown in FIG. 2, the metal is applied only to the platable plastic molded on antenna 202 to make plated surface 304. Metal does not adhere to the base 302. Extending from ports 206 are molded connectors 306. Molded connectors 306 are extensions of the plateable plastic. They are metalized at the same time that the plated surface 304 is metalized FIG. 4 shows a cross sectional view of antenna 202 and an antenna-mounting surface 402. Antenna-mounting surface 402 provides a common surface by which the antenna may be mounted to an additional housing, which is part of the wireless device, and to which the printed circuit board 204 may be mounted. Antenna mounting surface 402 provides a common surface by which the antenna may be mounted directly to the printed circuit board. Molded connectors 306 are shown un-deflected. In this case, molded connectors 306 are designed to extend beyond the base of antenna 202 such that when antenna 202 is mounted on surface 402, molded connectors 306 will deflect distance d. The deflection can be increased or decreased depending upon the amount of preloaded force onto the printed circuit board that is required. This deflection can be adjusted by extending the length of connectors 306.

Molded connectors are integral to the antenna such that a separate connector does not need to be inserted. While it is contemplated that the molded connectors would be formed in conjunction with making the antenna, be it part of the metal stamp or injection mold, for example. Instead of molded connectors attached to the antenna, it would also be possible to form contacts on the printed circuit board. However, it is believed larger manufacturing gains would result from having the connectors attached to the antenna.

Figure 5:
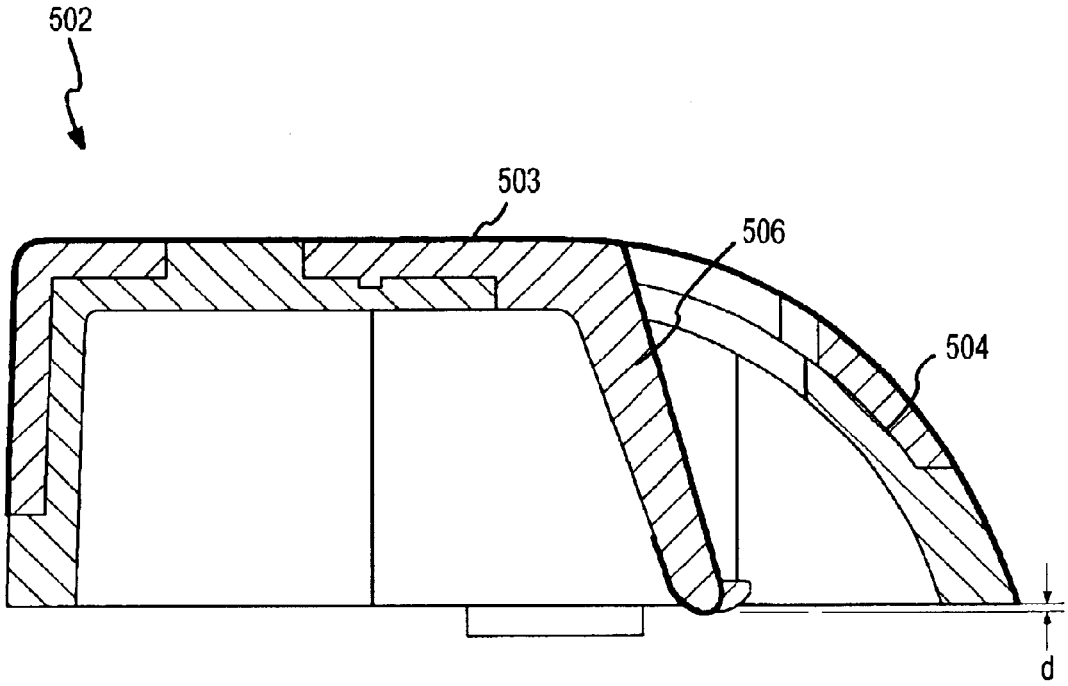
FIG. 5 is a cross sectional view of a flex board type antenna construction illustrating the electrical connection of the antenna assembly consistent with the present invention.
Figure 6:
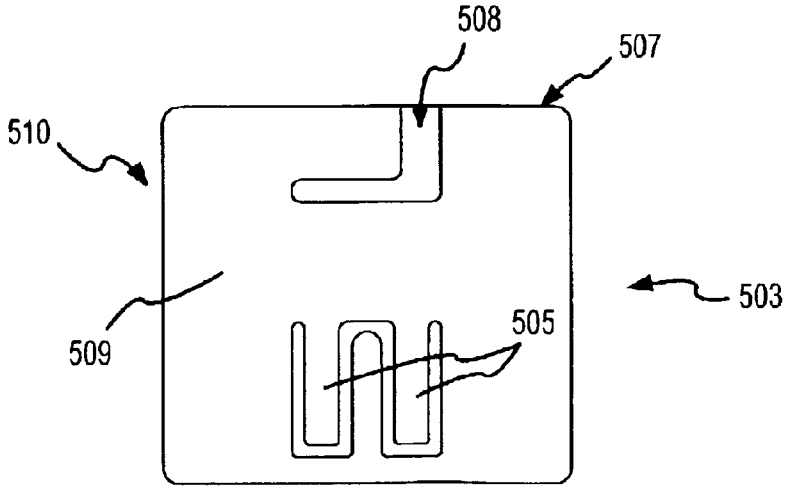
FIG. 6 is a plan view of the flex board type antenna of FIG. 5.

FIGS. 5 and 6 show a cross sectional view of another antenna 502 consistent with the present invention. Antenna 502 is shown having molded beams used as part of the antenna electrical connection. Antenna 502 comprises a flexible circuit board 503 on a carriage 504 (which may be made out of a one shot molded plastic). Carriage 504 includes molded beams 506 The methods to make a flexible circuit board antenna are generally known and will be briefly explained for completeness.

Generally, a layer of conductive material 509, such as, for example, copper, is coupled to a non-conductive substrate 510, such as, for example, Capton or Mylar. An adhesive 507 is coated on non-conductive substrate 510. Thus, non-conductive substrate 510 separates conductive material 509 and adhesive 507. A slot 508 is formed in the construct to quasi partition antenna 502 in a conventional manner. Flexible film 503 is coupled to antenna carriage 504, or some other surface capable of holding film, such as, for example, the handset housing wall (not shown). Legs 505 of flexible film 503 make electrical connection to the printed circuit board by wrapping around and attaching to molded beams 506 of carriage 504. Legs 505 are captured between the surface of the printed circuit board and the molded beam 506. The molded beams are designed in such a way as to provide a structure that, when bent will provide adequate force onto the printed circuit board. While the invention has been particularly shown and described with reference to an thereof, it will be understood by those skilled in the art that various other changes in the form and details may be made without departing from the spirit and scope of the invention.

We claim:

1. An antenna assembly comprising:

a carriage layer;

the carriage layer comprises a base layer comprising a first non-platable plastic, and a plating layer comprising a first platable plastic selective formed on the base layer;

at least one connector integrated into the carriage layer;

a metalized layer; and the metalized layer selectively covering the carriage layer and the at least one connector, wherein the at least one connector is adapted to form an electrical connection between the antenna assembly and a power source.

2. The antenna assembly according to claim 1, wherein the at least one molded connector comprises: at least one core layer.

3. The antenna assembly according to claim 2, wherein the at least one core layer comprises a first platable plastic.

4. The antenna assembly according to claim 4, wherein the at least one core layer comprises a second platable plastic.

5. The antenna assembly according to claim 2, wherein the at least one molded connector comprises:

at least one connector plating layer; and the at least one connector plating layer comprises at least a first platable plastic.

6. The antenna assembly according to claim 5, wherein the at least one core layer comprises at least a first non-platable plastic.

7. The antenna assembly according to claim 5, wherein the at least one core layer comprises at least a second non-platable plastic.

8. The antenna assembly according to claim 2, wherein the at least one molded connector comprises:

at least one connector plating layer; and the at least one connector plating layer comprises at least a second platable plastic.

9. The antenna assembly according to claim 8, wherein the at least one core layer comprises at least a first non-platable plastic.

10. The antenna assembly according to claim 8, wherein the at least one core layer comprises at least a second non-platable plastic.

11. An antenna assembly, comprising:

a carriage layer;

at least one connector having a distal end and a proximate end, the at least one connector is integrated into the carriage layer at the proximate end;

a metalized layer;

the metalized layer selectively covering the carriage layer and the at least one connector;

a printed circuit board;

the printed circuit board having at least one contact;

the at least one connector contacting the at least one contact at the at least one distal end, the at least one connector is a plated cantilever beam that is deflected when contacting the at least one contact a predetermined distance to provide contract force.

wherein at least one electrical connection is formed between the printed circuit board and the metalized layer selectively covering the carriage layer.

12. The antenna assembly according to claim 11, wherein the carriage layer comprises:

a base layer of a first non-platable plastic; and a plating layer of a first platable plastic.

13. The antenna assembly according to claim 12, wherein the at least one connector comprises:

a core; and the core is formed of at least a second platable plastic.

14. The antenna assembly according to claim 13, wherein the second platable plastic is the same as the first platable plastic.

* * * * *